US005333343A

United States Patent [19]

Nichols et al.

[11] Patent Number: 5,333,343

[45] Date of Patent: Aug. 2, 1994

[54] GOLF CLUB BRUSH FOR WOODS AND IRONS

[75] Inventors: Michael P. Nichols; Philip Dunn, both of League City, Tex.

[73] Assignee: No No, Inc., League City, Tex.

[21] Appl. No.: 886,054

[22] Filed: May 20, 1992

[51] Int. Cl.[5] ..... A47L 13/12

[52] U.S. Cl. ..... 15/106; 15/184

[58] Field of Search ..... 15/106, 111, 114, 118, 15/169, 184

[56] References Cited

U.S. PATENT DOCUMENTS

| | | | |
|---|---|---|---|
| 372,492 | 11/1887 | Schroeder | 15/184 |
| 806,333 | 12/1905 | Folden | 15/184 |
| 2,071,747 | 2/1937 | Houlihan | 15/184 |
| 2,682,072 | 6/1954 | Green | 15/111 |
| 2,701,378 | 2/1955 | Reinbolt | 15/111 |
| 4,734,953 | 4/1988 | Dodson | 15/106 |

FOREIGN PATENT DOCUMENTS

| | | | |
|---|---|---|---|
| 687948 | 3/1965 | Italy | 15/169 |
| 2477 | of 1893 | United Kingdom | 15/184 |

*Primary Examiner*—Timothy F. Simone
*Assistant Examiner*—Randall E. Chin
*Attorney, Agent, or Firm*—James L. Jackson

[57] ABSTRACT

A double brush mechanism for cleaning the grooves of the striking faces of wood and iron golf clubs comprises a housing having oppositely directed brush openings and forming an actuator slot having locking openings. A brush carrier is movable within the housing and has opposed brushes capable of being selectively projected from the housing for use. A brush carrier actuator is received in movable relation by the carrier and is urged in a locking direction by a compression spring. The actuator incorporates a manual manipulator button that is engaged and moved by the user and incorporates an actuator stem that is movable within the carrier actuator slot. The carrier is lockable at either of three positions along the length of the actuator slot to permit either of the brushes to be selectively exposed for use or locked within the housing for protection.

8 Claims, 2 Drawing Sheets

FIG. 1
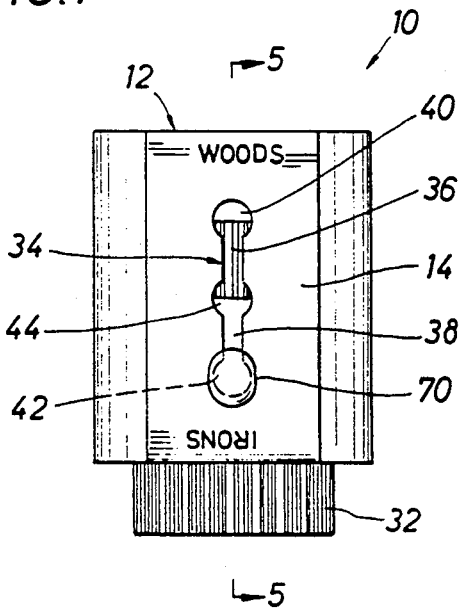
FIG. 2
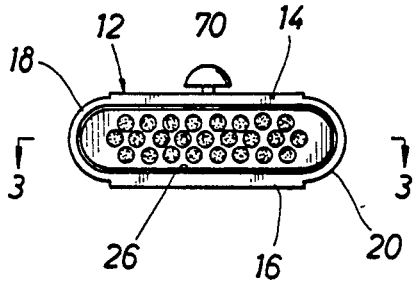
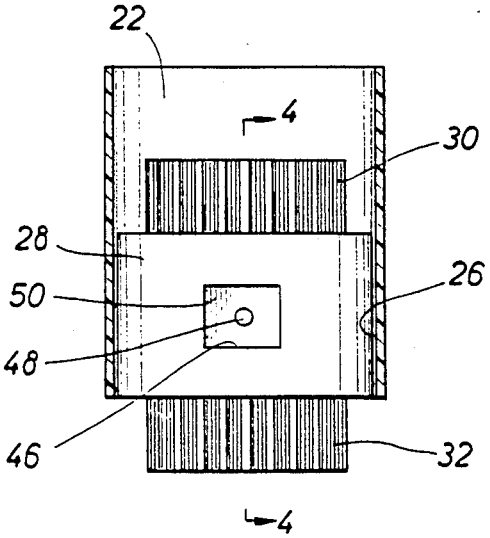
FIG. 3
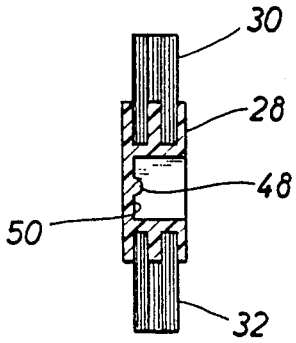
FIG. 4
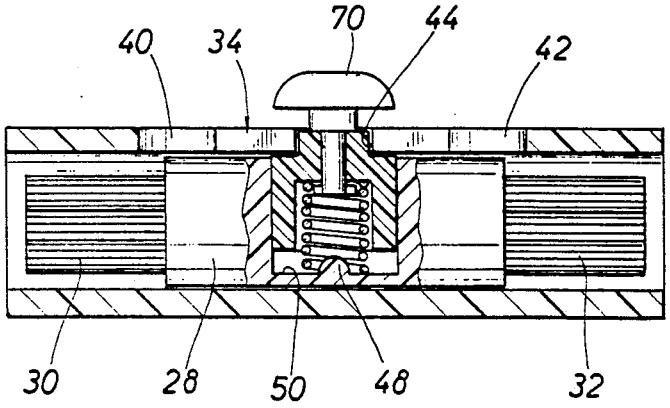
FIG. 5

GOLF CLUB BRUSH FOR WOODS AND IRONS

FIELD OF THE INVENTION

This invention relates generally to brushes that are suitable for cleaning the striking face grooves that are present on the heads of both wood and iron golf clubs. More specifically, the present invention is directed to a double sided golf club brush mechanism having a single brush carrier movably positioned within a housing with the brush carrier being selectively positioned within the housing to expose selected ones of the brushes for use and for locking the brush carrier at the selected position.

BACKGROUND OF THE INVENTION

In the playing of the game of golf, both wood and iron golf clubs are utilized. Wood golf clubs are utilized for driving the golf ball from a tee and for hitting a golf ball long distances from a fairway. Golf clubs known as "woods" may be composed of any of a number of materials including, wood, metal, polymer or composites thereof. Each of the woods defines a angulated striking face having a plurality of generally horizontal grooves formed therein. Each wood in a set of golf clubs, typically five at most, defines a different inclination or loft which determines the flight and distance the golf ball will travel when struck. Iron golf clubs, typically referred to as "irons" are most always formed of metal. Each iron defines an inclined striking face with each iron in a set of golf clubs being differently inclined or lofted to provide for hitting of a golf ball at various controlled distances and elevations. Depending upon the distance from the position or lie of a golf ball in relation to an intended golf green and the particular character of the terrain forming the fairway and the green, and because of any number of other variables, a golfer will select a particular iron for striking the ball so as to propel the ball from its position of lie to its position on the green. Irons are also provided with a plurality of horizontal grooves on the striking face thereof.

As mentioned above, both woods and irons have varying degrees of loft so as to provide the golf ball with a degree of upward movement during its trajectory after having been struck by a golf club. The horizontal grooves in the striking faces of golf clubs provide a gripping characteristic between the ball and the golf club as the ball is struck because some of the tough, resilient outer cover of the golf ball becomes displaced into the grooves upon impact of the golf club with the ball. The gripping characteristic caused by this displacement imparts an underspin to the golf ball such that it typically has a characteristic of climb during its trajectory. This underspin also has the characteristic of retarding forward movement of the ball as it strikes the fairway or green. This underspin or backspin is especially critical in controlled positioning of a golf ball on a green as the result of a golf shot. Thus, with minimal backspin, a golf ball will tend to roll forwardly or run a considerable distance after it has landed on a golf green. Conversely, with maximum backspin, the golf ball will tend to stop immediately on a green, and, in some cases, reverse its direction because of the rapid backspin. The capability of achieving controlled backspinning of a golf ball for stopping its forward movement and for backing it up are highly desirable attributes that are considered necessary for efficient playing of the game of golf.

When a golf ball laying on a fairway is struck by a wood or iron to propel it to or toward a green or to a controlled position on a fairway, the arc of movement of the head of the golf club typically passes through the golf ball and through the upper portion of the turf on which the golf ball is lying. For this reason, when a golf ball is properly struck by a golf club, the club will form a divit in the fairway or the tee by coming into contact with the grass and earth on which the golf ball is lying. When a golf ball is struck in this manner, bits of debris, including grass and earth, typically enter the grooves of the golf club striking face. If this debris is allowed to remain in the grooves, when subsequently striking the golf ball, the presence of the debris will impede backspinning capability. Thus it is highly desirable to insure that the hitting face on both wood and iron golf clubs remain efficiently clean of debris for each golf shot so that desirable backspin can be imparted to the golf ball each time it is struck. for this reason many golfers frequently clean the striking face grooves with towels, brushes, etc.

It is well known that brushes for cleaning the striking face grooves of golf clubs must be of different character depending whether woods or irons are being cleaned. For the cleaning of irons, because irons are typically composed of metal, the brush can be of quite harsh character. In fact, it may be composed of a metal such as brass or bronze as well as other relatively stiff or harsh non-metal materials. In the case of woods, however, especially where the golf club is composed of wood and perhaps includes a striking face insert of wood or another relatively soft material, the golf club cleaning brush must be of a different character. In this case, the golf club brush must be of a relatively soft nature so as not to degrade the hitting face of the golf club during the cleaning process. Consequently, golfers have historically provided themselves with two golf club cleaning brushes, one composed of a material suitable for the cleaning of irons and the other composed of a material suitable for the cleaning of woods. It is also well known that these groove cleaning brushes frequently become misplaced in the golf bag and they can cause scratching of other objects that are typically present in the golf bag.

To enable golf participants to have in a single unit a dual golf club brush mechanism for selective cleaning of woods and irons, a dual golf club brush assembly has been developed as set forth in U.S. Pat. No. 4,734,953 of Dodson.

It is considered desirable to provide a dual or double golf club brush assembly having a single brush carrier movably positioned within a housing and having brushes at opposed sides thereof, one being of a character for the cleaning of irons and the other being of a character for the cleaning of woods. It is also considered desirable to provide a dual golf club brush assembly having a single brush carrier which is capable of being locked at selected positions for efficient and effective use of selected brushes by golf players and for protecting the brushes while they are not being used.

SUMMARY OF THE INVENTION

It is a primary feature of the present invention to provide a novel dual golf club brush assembly incorporating a single housing having oppositely directed, opposed openings and incorporating a single brush carrier movable therein and having opposed brushes extending oppositely from the brush carrier which are selectively positionable to expose selected ones of the brushes for use as the brush carrier is selectively positioned within the housing.

It is also a feature of the present invention to provide a novel dual golf club brush mechanism having means for selectively locking the brush carrier at selected position such that selected ones of the golf club brushes are exposed for use and a position where the golf club brushes are both retracted to protected position within the housing.

Briefly, the present invention concerns a double opposed brush mechanism for cleaning wood and iron golf clubs which includes a housing forming first and second oppositely directed openings. A brush carrier is movably positioned within the housing and is provided with first and second golf club brushes which project in opposed relation therefrom, one of the brushes being suitable for the cleaning of wood golf clubs and the other being suitable for the cleaning of iron golf clubs. The brush carrier is manually movable within the housing by a golf player who manually manipulates or positions a brush carrier actuator that projects through an elongate slot or opening defined in one wall surface of the housing. The elongate slot is of a configuration permitting linear movement of the brush carrier actuator and defining three locking positions for the brush carrier actuator and thus the brush carrier relative to the housing. The brush carrier actuator also includes a locking mechanism capable of establishing locking relation with each of the locking position openings of the housing. This feature allows the brush carrier to be selectively locked at selected positions at each end of its linear travel for selectively exposing either of the first and second brushes for use. The third locking opening is located intermediate the length of the elongate slot and receives the locking mechanism of the brush carrier actuator in order to lock the brush carrier in an intermediate position such that both of the first and second brushes are enclosed within the housing for protection thereof and for protection of objects that might otherwise be contacted by the brushes.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

FIG. 1 is a plan view of a double, opposed golf club cleaning brush assembly constructed in accordance with the present invention and showing one of the brushes thereof exposed for use.

FIG. 2 is an end view of the double, opposed golf club cleaning brush of FIG. 1.

FIG. 3 is a partial sectional view taken along line 3—3 of FIG. 2 and showing the relationship of the brush carrier and opposed brushes relative to the housing structure with one brush being in position for use.

FIG. 4 is a sectional view taken along the line 4—4 of FIG. 3 and showing the cross-sectional configuration of the brush carrier structure thereof.

FIG. 5 is a sectional view taken along line 5—5 of FIG. 1 and illustrating locking of the brush carrier relative to the housing structure.

Figure 6:
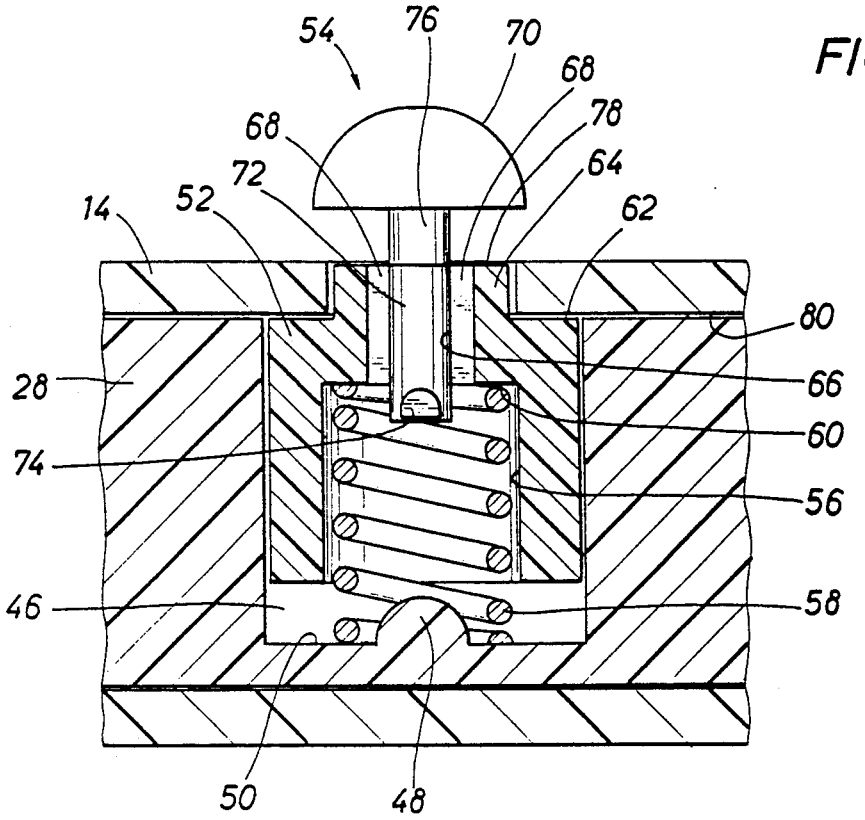

FIG. 6 is a fragmentary sectional view illustrating the brush carrier locking mechanism in detail.

Figure 7:
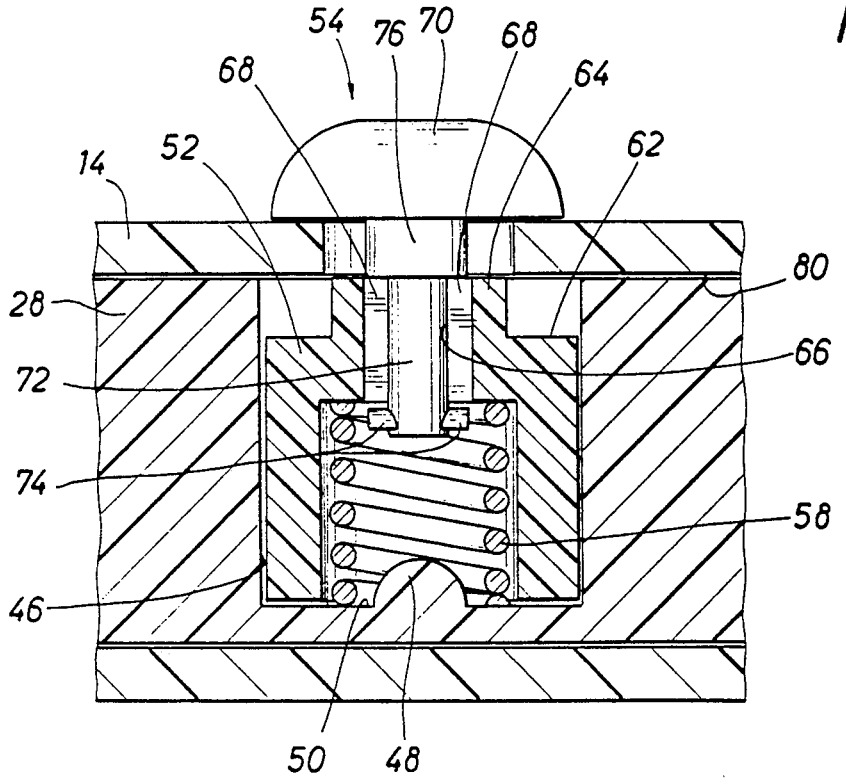

FIG. 7 is a fragmentary sectional view similar to that of FIG. 6 illustrating the brush carrier locking mechanism in its unlocked position.

DETAILED DESCRIPTION OF PREFERRED EMBODIMENT

Referring now the drawings and first to FIG. 1, a double, opposed golf club groove cleaning brush mechanism having a locking capability is illustrated generally at 10 and incorporates a housing structure shown generally at 12 which incorporates upper and lower generally planar wall structures 14 and 16 which are integrally interconnected by arcuate or curved end walls 18 and 20. The housing structure defines opposed brush openings 22 and 24 which define respective ends of an open internal brush compartment 26.

Within the brush carrier compartment 26 of the housing 12 is movably positioned a brush carrier 28 having first bristles 30 protruding from one end thereof and being of a suitable character for the cleaning of the striking face grooves of wood golf clubs. The bristles 30 may be composed of a number of suitable materials such as natural bristle, polymer bristles, etc. such as are deemed suitable for cleaning the striking face grooves without deteriorating the striking face of the woods. Second bristles 32 are also secured to the brush carrier 28 and project therefrom in a direction opposing the direction of the first bristles 30. The second bristles 32 are composed of a suitable material for the efficient cleaning of the striking face grooves of iron golf clubs. These bristles are fairly stiff and, for example, may be composed of any of a number of suitable metal materials such as brass, bronze, etc., or they may be composed of fairly stiff polymer materials that are considered suitable for efficient cleaning of irons.

The brush carrier 28 together with the first and second bristles 30 and 32 are of a combined dimension such that when the brush carrier is centralized within the brush carrier 26 both of the bristles 30 and 32 will be enclosed within and protected by the housing. Since the bristles may be retracted and secured within the housing in this manner, they will not tend to come into contact with other objects and cause undesirable scraping and scratching thereof.

The brush carrier 28, together with the integral bristles thereof, is also positionable at a first position within the brush carrier chamber 26 such that the first bristles project through the brush opening 22 and are exposed for use in the cleaning of wood golf clubs. The brush carrier 28 is also positionable at a second position within the brush carrier compartment 28 such that the second bristles 32 project through the housing opening 24 and are exposed for use in the cleaning of the striking face grooves of iron golf clubs. This second brush carrier position is illustrated in FIGS. 1 and 3.

It is considered desirable to provide for locking of the brush carrier 28 at either its first or second positions relative to the housing so that the respective first or second bristles, as the case may be, will be exposed for active use and the brush carrier will not inadvertently retract during use. It is also desirable to provide for locking of the brush carrier 28 at a third or intermediate position within the brush carrier chamber 26 so that the brush carrier will not inadvertently move to a position exposing either of the first or second bristles. This feature effectively secures the brush carrier and bristles within a protected condition within the housing so that the respective bristles do not become fouled and so that other objects which might come into contact with the brush assembly 10 will not become inadvertently scratched or marred by exposed bristles. To accomplish this three position locking feature, the upper wall 14 of the housing 12 is formed to define an elongate slot shown generally at 34 and which incorporates narrow slot sections 36 and 38 having generally circular, enlarged first and second locking extremities 40 and 42. The elongate slot 34 is also provided with an enlarged, generally circular intermediate locking opening 44.

To permit movement and positional locking of the brush carrier 28 relative to the housing structure 12, the brush carrier defines a centrally oriented, generally rectangular depression 46 forming a locking receptacle and having a centrally oriented, partially spherical boss 48 protruding upwardly from the generally planar bottom surface 50. Within the rectangular depression or receptacle 46 is movably positioned a generally rectangular insert 52 having interconnected therewith a combination carrier actuator and carrier lock element shown generally at 54.

The locking insert 52 defines an internal spring guide receptacle 56 which receives a portion of a compression spring 58. One end of the compression spring is centered within the receptacle 46 by the projection 48 while the opposite end of the spring engages an internal shoulder 60 of the insert 52 thereby urging the insert in a direction away from the planar bottom surface 50 of the carrier actuator receptacle. The locking insert defines a stop shoulder 62 and a locking projection 64 which extends beyond the plane defined by the stop shoulder. In its locking position, as shown in FIG. 6, the locking projection 64 enters one of the locking openings 40, 42 or 44 under the influence of the compression spring 58. In this locking position, linear movement of the insert 52 along the actuator slot 34 is prevented because locking projection 64 is of greater width than the width of the actuator slot sections 36 and 38. In the position shown in FIG. 6, the locking projection 64 secures the brush carrier 28 at either of the selected positions described above for use of a selected brush or for protection of both of the brushes within the housing.

The insert 52 defines an actuator stem passage 66 having opposed keyways 68. A carrier actuator 70 is provided with an actuator stem 72 which extends through the passage way 66 and further includes transverse keys 74 at one end thereof which are of a dimension for passage through the keyways 68. The actuator 70 is interconnected with the insert 52 by extending the stem 72 through the passage 66 with the keys 74 passing through the keyways 68. After the keys 74 have cleared the internal shoulder 60 the actuator is rotated 90° to position the keys 74 out of registry with the keyways 68. When this occurs, a shoulder 76, defined on the actuator 70, establishes supporting contact with an outwardly facing shoulder 78 of the locking projection 64 and prevents actuator stem movement in the opposite direction relative to the insert, thereby securing the actuator in substantially immovable, locked relation with the insert 52.

With regard to FIG. 7, the actuator element 70 is shown 90° out of phase with respect to its normal operation with the insert 52. These parts are shown in this manner to identify alignment of the keys 74 of the actuator stem 72 with the keyways 68 for the purpose of assembling the actuator 70 to the insert 52. As mentioned above, after insertion of the actuator stem 72 through the passage 66, the actuator element 70 is rotated 90° to position the keys 74 in the manner shown in FIG. 6.

To unlock the actuator 54 and to permit sliding movement of the carrier actuator along the length of the carrier actuator slot 34, the actuator button 71 of the carrier actuator 70 is depressed manually, thereby compressing the spring 58 and urging the insert 52 more deeply into the receptacle 46. This causes the stop shoulder 62 to move away from the inner surface 80 of the housing wall 14 and causing the locking projection 64 to be withdrawn from its locking relation within the respective locking opening 40, 42 or 44. After the insert 52 has been moved to the position shown in FIG. 7 by manual manipulation of the actuator button 71, lateral manual force on the brush carrier actuator 70 actuator button will shift the actuator, insert and brush carrier within the housing to a desired position. After the actuator button has been manually shifted laterally sufficiently to shift the locking projection 64 out of registry with a respective one of the locking openings, release of the actuator button will permit the compression spring 58 to urge the locking projection 64 into engagement with the inner surface 80 of the housing wall 14. In this condition the actuator button 70 may simply be moved linearly so as to cause the actuator to track along a respective one of the narrow slot sections 36 or 38. After sufficient lateral movement of the actuator button has occurred to bring the locking projection into registry with another of the locking openings 40, 42 or 44 the spring 58 will snap the locking projection 64 of the insert 52 into the aligned locking opening such that the locking insert will again assume the locked position set forth in FIG. 6 though at a different position within the housing 12. Thus, by applying manual force the brush carrier may be unlocked and shifted within the housing to either of its two extreme positions along the length of the actuator slot, thus selectively exposing either the wood cleaning brush or the iron cleaning brush for use. Alternatively, the actuator and locking mechanism may be appropriately manipulated to shift the brush carrier to its intermediate position, thereby securing both of the wood and iron cleaning brushes at a protected position within the housing.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and al 1 changes which come within the meaning and range of the equivalence of the claims are therefore intended to be embraced therein.

What is claimed is:

1. A double brush mechanism for cleaning the striking face grooves of wood and iron golf clubs, comprising:

(a) a generally rectangular housing being of integral construction and having generally planar and parallel related upper and lower side walls and opposed curved end walls interconnecting said side walls, said housing further defining first and second oppositely directed brush openings, said upper side wall defining an elongate generally straight brush carrier actuator slot having generally circular locking enlargements at each extremity thereof and a generally circular locking enlargement intermediate the extremities thereof;

(b) a brush carrier being movably positioned within said housing and defining a locking receptacle therein;

(c) a brush carrier actuator being movably received within said locking receptacle of said brush carrier and being disposed in registry with said elongate brush carrier actuator slot, said brush carrier actuator being manually movable along the length of said elongate brush carrier actuator slot to induce selective movement of said brush carrier within said housing, said brush carrier actuator further having a locking element thereon of greater width than said elongate brush carrier actuator slot and being of a dimension for selective locking engagement within said extremity and intermediate locking enlargements of said elongate brush carrier actuator slot to lock said brush carrier at selected positions within said housing, said brush carrier actuator further defining an internal spring guide;

(d) an actuator stem extending from said brush carrier actuator through said brush carrier actuator slot and having a button thereon for manual manipulation;

(e) a first brush being fixed to one side of said brush carrier and adapted to be extended through said first brush opening of said housing upon selected positioning of said brush carrier within said housing, said first brush being defined by polymer cleaning bristles suitable for cleaning the striking face grooves of wood golf clubs;

(f) a second brush being fixed to said brush carrier and oriented in opposed relation with said first brush and being positioned for extension through said second brush opening of said housing upon selective positioning of said brush carrier within said housing, said second brush being defined by metal cleaning bristles suitable for cleaning the striking face grooves of iron golf clubs, the combined length of said brush carrier and said first and second brushes being substantially equal to spacing of said first and second brush openings of said housing; and (g) a spring being disposed within said locking receptacle and being received by said internal spring guide and continuously urging said locking element toward the locking position thereof and moving said locking element outwardly into a selected one of said locking enlargements upon being positioned in registry therewith, said locking element selectively locking sand brush carrier relative to said housing at a first position where said first selected brush is exposed for use, a second position where said second selected brush is exposed for use, and an intermediate position where both said first and second brushes are positioned within said generally rectangular housing.

2. The double brush mechanism of claim 1, wherein: said brush carrier actuator is movable to locking and unlocking positions relative to said brush carrier and said housing, at said locking position said brush carrier actuator establishing locking engagement with a selected one of said locking enlargements under the force of said spring.

3. The double brush mechanism of claim 1, wherein: said actuator stem defines a dimension less than the width of said brush carrier actuator slot for traversing the entire length of said elongate brush carrier actuator slot.

4. The double brush mechanism of claim 1, wherein:

(a) said elongate brush carrier actuator slot defines a predetermined slot dimension being less than the dimension of said locking enlargements;

(b) said locking element of said brush carrier actuator having a width exceeding said predetermined slot dimension being of a dimension to be receivable within said locking enlargements; and (c) said actuator stem having a width less than said predetermined slot dimension for traversing the length of said elongate brush carrier actuator slot.

5. A selective, locking, double brush mechanism for cleaning the striking face grooves of wood and iron golf clubs, comprising:

(a) a housing having upper and lower side walls and curved end walls and defining first and second oppositely directed brush openings, said upper side wall defining a brush carrier actuator slot having a specified width along the length thereof and having locking enlargements at each end thereof and a locking enlargement intermediate the ends thereof;

(b) a brush carrier being movably positioned within said housing and defining an actuating and locking receptacle therein;

(c) a brush carrier actuator insert being movably received within said actuating and locking receptacle and defining a locking projection of greater dimension than said brush carrier actuator slot and a dimension to be received within said locking enlargements for releasably locking said brush carrier at selected positions relative to said housing, said brush carrier actuator insert further defining a spring guide and an actuator stem passage having keyways, said brush carrier insert being disposed in registry with said elongate brush carrier actuator slot and being manually movable linearly along said brush carrier actuator slot to induce selective movement of said brush carrier within said housing;

(d) a carrier actuator and lock element having a carrier actuator stem being movably received within said actuator stem passage of said brush carrier actuator insert and having transverse keys thereon adapted for passage through said keyways, said transverse keys being orientable out of registry with said keyways for retaining said carrier actuator and lock element in assembly with said brush carrier actuator insert;

(e) a spring being disposed within said actuating and locking receptacle and in guided relation with said spring guide, said spring continuously urging said brush carrier actuator insert toward said brush carrier actuator slot and upon registry of said locking projection with either of said locking enlargements moving said locking projection into locking relation within the respective locking enlargement;

(f) a first brush being fixed to one side of said brush carrier and adapted to be extended through said first opening of said housing upon selected positioning of said brush carrier within said housing, said first brush being defined by cleaning bristles suitable for cleaning the striking face grooves of wood golf clubs; and (g) a second brush being fixed to said brush carrier and oriented in opposed relation with said first brush and being positioned for extension through said second opening of said housing upon selective positioning of said brush carrier within said housing, said second brush being defined by cleaning bristles suitable for cleaning the striking face grooves of iron golf clubs.

6. The selective locking brush mechanism of claim 5 wherein:

(a) said brush carrier actuator insert having internal surfaces defining an internal spring receptacle comprising said spring guide; and (b) said spring being a coil spring having an end portion thereof received within said internal spring receptacle and being oriented and guided by said internal surface.

7. The selective locking brush mechanism of claim 6, wherein:

a boss is defined by said brush carrier and located centrally of said locking receptacle, said boss orienting one end of said coil spring in centralized relation within said locking receptacle.

8. The selective locking brush mechanism of claim 5, wherein:

(a) said transverse keys limit linear movement of said actuator stem in one direction relative to said brush carrier actuator insert when said transverse keys are out of registry with said keyways; and (b) said actuator stem defining a locking shoulder having restraining engagement with said locking projection and limiting linear movement of said actuator stem in the opposite linear direction relative to said brush carrier actuator insert, said transverse keys and said locking shoulder establishing substantially immovable linear relation of said actuator stem with said brush carrier actuator insert when said transverse keys are out of registry with said keyways.

* * * * *